US006053650A

United States Patent [19]

Bennett et al.

[11] Patent Number: 6,053,650

[45] Date of Patent: Apr. 25, 2000

[54] PAINT APPLICATOR

[76] Inventors: Christie Bennett; William Bennett, both of 2000 Foster Trace Ct., Lawrenceville, Ga. 30043

[21] Appl. No.: 09/371,389

[22] Filed: Aug. 10, 1999

[51] Int. Cl.[7] ..... B05C 17/02

[52] U.S. Cl. ..... 401/208; 401/213; 401/219

[58] Field of Search ..... 401/208, 209, 401/213, 219

[56] References Cited

U.S. PATENT DOCUMENTS

| | | | |
|---|---|---|---|
| 4,150,904 | 4/1979 | Stewart | 401/186 |
| 4,389,132 | 6/1983 | Valadez | 401/195 |
| 4,522,523 | 6/1985 | Vogelsang | 401/126 |
| 4,723,860 | 2/1988 | Giblin et al. | 401/208 |
| 5,051,016 | 9/1991 | Bengston | 401/208 |
| 5,395,175 | 3/1995 | Bontoux et al. | 401/1 |

FOREIGN PATENT DOCUMENTS

| | | | |
|---|---|---|---|
| 399217 | 3/1966 | Switzerland | 401/208 |

*Primary Examiner*—Charles R. Eloshway
*Attorney, Agent, or Firm*—Joseph N. Breaux

[57] ABSTRACT

A paint applicator that is fillable with a quantity of paint that includes an internal roller assembly for applying touch up paint to desired areas. The roller assembly is sealable between uses to prevent the necessity of cleaning the roller assembly between uses. The sealing cap is transparent to allow the user to rapidly identify the required color from a number of such paint applicators.

1 Claim, 2 Drawing Sheets

16
II
14
II
10
12

PAINT APPLICATOR

TECHNICAL FIELD

The present invention relates to painting devices and more particularly to a paint applicator within which a small quantity of touch up paint is stored and which can be used a number of times to cover small flaws or damage to a painted area such as a wall and resealed for use at a later time; the paint applicator including a flexible walled paint container, an applicator head cap assembly threadably attachable to the paint container, and a transparent applicator head sealing cap threadably sealable over the applicator head assembly; the paint container having a paint reservoir defined therein in connection with a neck opening defined by an exteriorly threaded neck portion; the applicator head cap assembly including a head cap member having an internally threaded bottom portion companionately threaded to thread onto the exteriorly threaded neck portion of the paint container, an externally threaded portion, a horizontally oriented, semi-cylindrical roller cavity formed in connection with a head cap member top surface, a duck bill one-way valve positioning cavity within the head cap member in connection with the roller cavity, a paint passageway in connection between the duck bill one-way valve positioning cavity and the internally threaded bottom portion in a manner to form a fluid pathway from the paint reservoir of the paint container into the roller cavity of the head cap member when the head cap member is threaded fully onto the exteriorly threaded neck portion of the paint container, a resilient duck bill one-way valve installed within the duck bill one-way valve positioning cavity in a manner to allow paint flow from the paint reservoir to the roller cavity and prevent the backflow of paint from the roller cavity to the paint reservoir, and a cylinder shaped paint applicator roller member rotatably entrapped within the roller cavity having greater than fifty percent of the volume thereof positioned within the roller cavity and a remaining portion thereof extending past the head cap member top surface; the transparent applicator head sealing cap having internal threaded companionate with the externally threaded portion of the head cap member and an internal cavity sized and shaped such that an internal top surface defining the top of the internal cavity is in contact with the paint applicator roller member when the transparent applicator head sealing cap is fully threaded onto the externally threaded portion of the head cap member; the paint container having sidewalls sufficiently flexible to allow a compression force to be developed by squeezing to force paint within the paint reservoir through the duck bill one-way valve into the roller cavity.

BACKGROUND ART

Painted surfaces can rapidly become marked and damaged through use and require frequent touch up painting to remain in like new condition. Although it is often desirable to maintain painted surfaces in like new condition, it can be time consuming to open paint cans and to clean paint brushes and rollers each time touch up painting is required. It would be desirable, therefore, to have a paint applicator that could be filled with a quantity of paint that included an internal roller assembly for applying the paint to touch up desired areas that could be sealed between uses to prevent the necessity of cleaning the internal roller assembly between uses.

GENERAL SUMMARY DISCUSSION OF INVENTION

It is thus an object of the invention to provide a paint applicator that includes a flexible walled paint container, an applicator head cap assembly threadably attachable to the paint container, and a transparent applicator head sealing cap threadably sealable over the applicator head assembly; the paint container having a paint reservoir defined therein in connection with a neck opening defined by an exteriorly threaded neck portion; the applicator head cap assembly including a head cap member having an internally threaded bottom portion companionately threaded to thread onto the exteriorly threaded neck portion of the paint container, an externally threaded portion, a horizontally oriented, semi-cylindrical roller cavity formed in connection with a head cap member top surface, a duck bill one-way valve positioning cavity within the head cap member in connection with the roller cavity, a paint passageway in connection between the duck bill one-way valve positioning cavity and the internally threaded bottom portion in a manner to form a fluid pathway from the paint reservoir of the paint container into the roller cavity of the head cap member when the head cap member is threaded fully onto the exteriorly threaded neck portion of the paint container, a resilient duck bill one-way valve installed within the duck bill one-way valve positioning cavity in a manner to allow paint flow from the paint reservoir to the roller cavity and prevent the backflow of paint from the roller cavity to the paint reservoir, and a cylinder shaped paint applicator roller member rotatably entrapped within the roller cavity having greater than fifty percent of the volume thereof positioned within the roller cavity and a remaining portion thereof extending past the head cap member top surface; the transparent applicator head sealing cap having internal threaded companionate with the externally threaded portion of the head cap member and an internal cavity sized and shaped such that an internal top surface defining the top of the internal cavity is in contact with the paint applicator roller member when the transparent applicator head sealing cap is fully threaded onto the externally threaded portion of the head cap member; the paint container having sidewalls sufficiently flexible to allow a compression force to be developed by squeezing to force paint within the paint reservoir through the duck bill one-way valve into the roller cavity.

Accordingly, a paint applicator is provided. The paint applicator includes a flexible walled paint container, an applicator head cap assembly threadably attachable to the paint container, and a transparent applicator head sealing cap threadably sealable over the applicator head assembly; the paint container having a paint reservoir defined therein in connection with a neck opening defined by an exteriorly threaded neck portion; the applicator head cap assembly including a head cap member having an internally threaded bottom portion companionately threaded to thread onto the exteriorly threaded neck portion of the paint container, an externally threaded portion, a horizontally oriented, semi-cylindrical roller cavity formed in connection with a head cap member top surface, a duck bill one-way valve positioning cavity within the head cap member in connection with the roller cavity, a paint passageway in connection between the duck bill one-way valve positioning cavity and the internally threaded bottom portion in a manner to form a fluid pathway from the paint reservoir of the paint container into the roller cavity of the head cap member when the head cap member is threaded fully onto the exteriorly threaded neck portion of the paint container, a resilient duck bill one-way valve installed within the duck bill one-way valve positioning cavity in a manner to allow paint flow from the paint reservoir to the roller cavity and prevent the backflow of paint from the roller cavity to the paint reservoir, and a cylinder shaped paint applicator roller member rotatably entrapped within the roller cavity having greater than fifty percent of the volume thereof positioned within the roller cavity and a remaining portion thereof extending past the head cap member top surface; the transparent applicator head sealing cap having internal threaded companionate with the externally threaded portion of the head cap member and an internal cavity sized and shaped such that an internal top surface defining the top of the internal cavity is in contact with the paint applicator roller member when the transparent applicator head sealing cap is fully threaded onto the externally threaded portion of the head cap member; the paint container having sidewalls sufficiently flexible to allow a compression force to be developed by squeezing to force paint within the paint reservoir through the duck bill one-way valve into the roller cavity.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
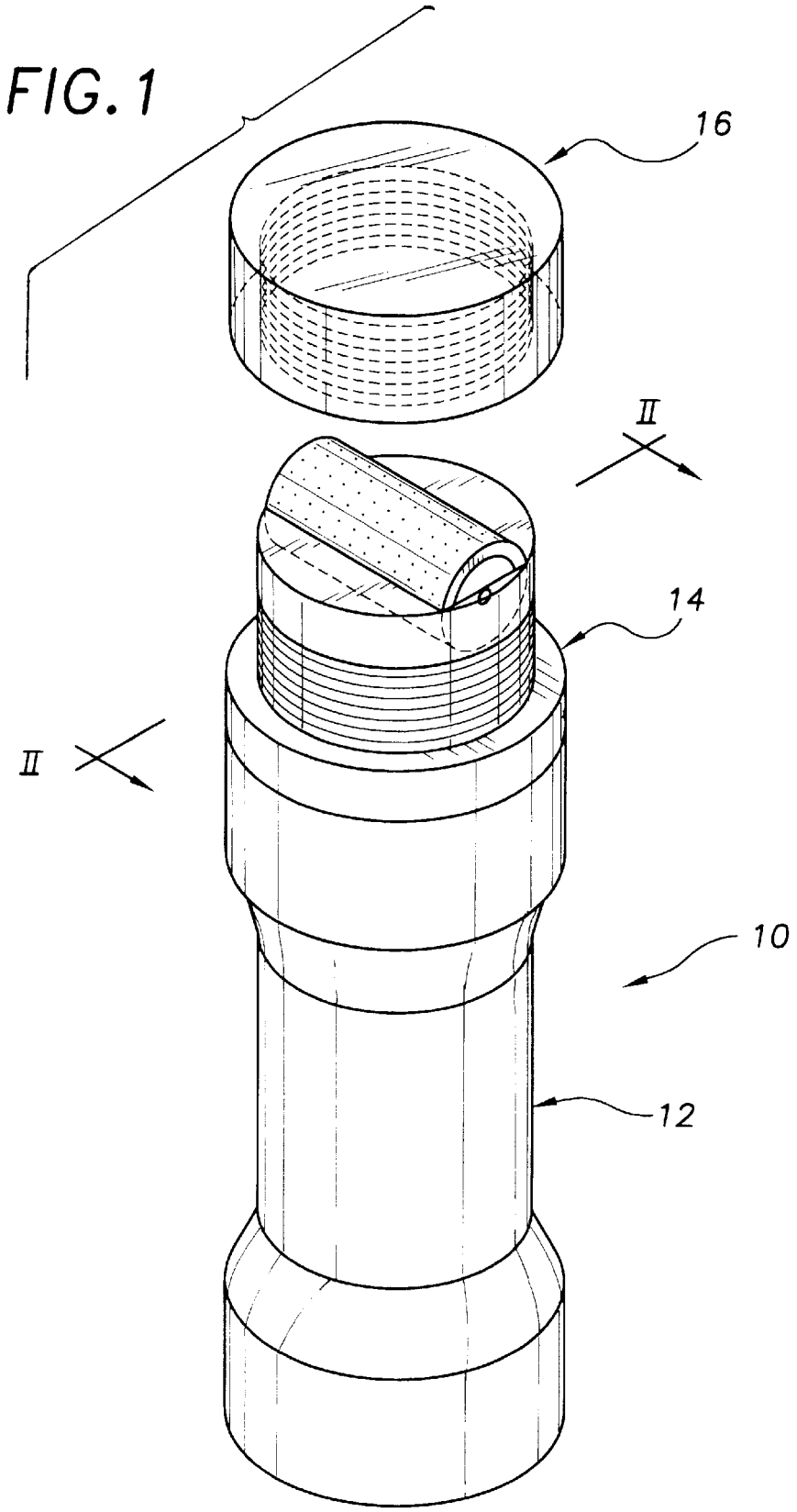
FIG. 1 is a perspective view of an exemplary embodiment of the paint applicator of the present invention including the flexible paint container; the applicator head cap assembly threadably attached to the paint container; and the transparent applicator head sealing cap threadably sealable over the applicator head assembly; the paint container having a paint reservoir defined therein in connection with a neck opening defined by an exteriorly threaded neck portion; the applicator head cap assembly including a head cap member having an internally threaded bottom portion companionately threaded to thread onto the exteriorly threaded neck portion of the paint container, an externally threaded portion, a horizontally oriented, semi-cylindrical roller cavity formed in connection with a head cap member top surface, a duck bill one-way valve positioning cavity within the head cap member in connection with the roller cavity, a paint passageway in connection between the duck bill one-way valve positioning cavity and the internally threaded bottom portion in a manner to form a fluid pathway from the paint reservoir of the paint container into the roller cavity of the head cap member when the head cap member is threaded fully onto the exteriorly threaded neck portion of the paint container, a resilient duck bill one-way valve installed within the duck bill one-way valve positioning cavity in a manner to allow paint flow from the paint reservoir to the roller cavity and prevent the backflow of paint from the roller cavity to the paint reservoir, and a cylinder shaped paint applicator roller member rotatably entrapped within the roller cavity having greater than fifty percent of the volume thereof positioned within the roller cavity and a remaining portion thereof extending past the head cap member top surface; the transparent applicator head sealing cap having internal threaded companionate with the externally threaded portion of the head cap member and an internal cavity sized and shaped such that an internal top surface defining the top of the internal cavity is in contact with the paint applicator roller member when the transparent applicator head sealing cap is fully threaded onto the externally threaded portion of the head cap member; the paint container having sidewalls sufficiently flexible to allow a compression force to be developed by squeezing to force paint within the paint reservoir through the duck bill one-way valve into the roller cavity.

FIG. 1 shows an exemplary embodiment of the paint applicator of the present invention generally designated 10. Paint applicator 10 includes a flexible walled paint container, generally designated 12; an applicator head cap assembly, generally designated 14, that is threadably attachable to paint container 12; and a transparent applicator head sealing cap, generally designated 16, that is threadably sealable over applicator head assembly 14.

Figure 4:
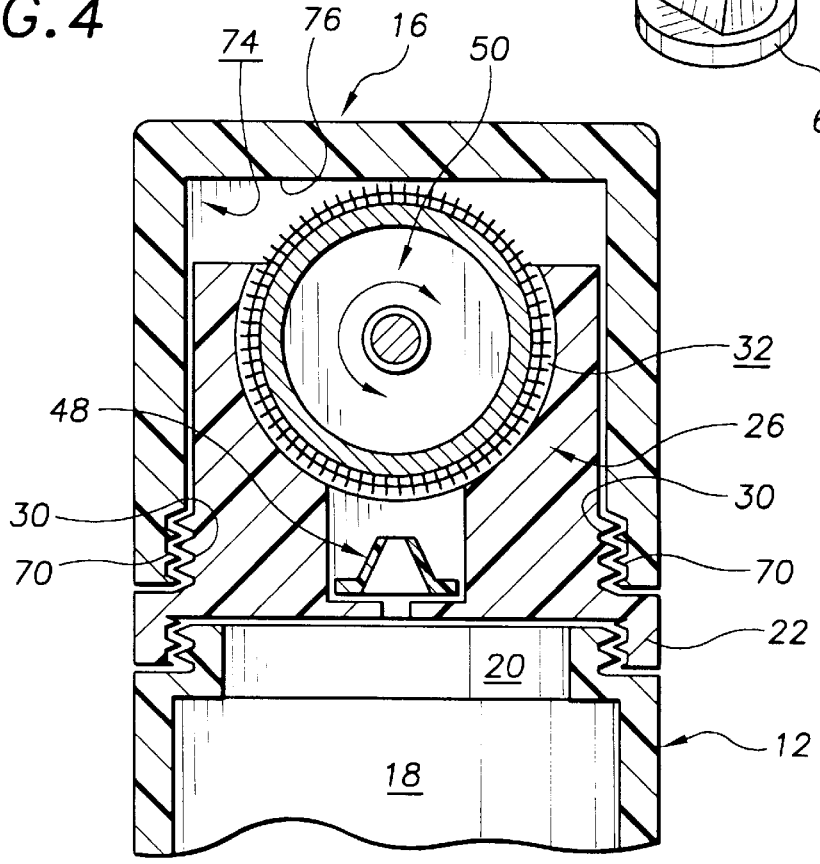
FIG. 4 is a cross sectional view showing the flexible paint container threaded into the applicator head cap assembly and the transparent applicator head sealing cap threaded onto the and sealing the applicator head assembly.

Paint container 12 is of conventional blow molded plastic construction and includes, referring to FIG. 4, a paint reservoir 18 defined therein in connection with a neck opening 20 defined by an exteriorly threaded neck portion 22.

Figure 2:
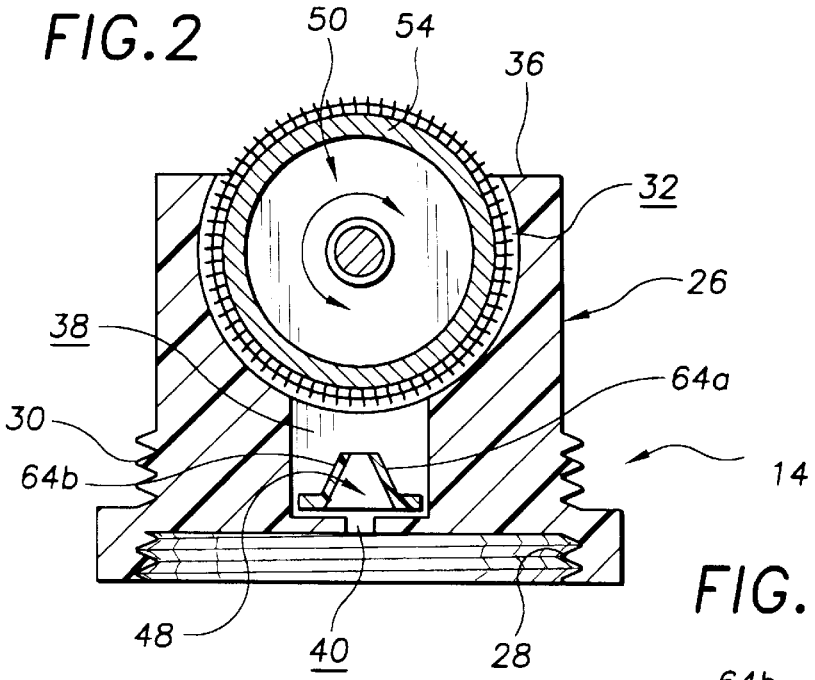
FIG. 2 is a cross sectional view of the applicator head cap assembly along the line II—II showing the head cap member with internally threaded bottom portion, the externally threaded portion, the horizontally oriented, semi-cylindrical roller cavity formed in connection with the head cap member top surface, the duck bill one-way valve positioning cavity, the paint passageway, and the internally threaded bottom portion; the resilient duck bill one-way valve installed within the duck bill one-way valve positioning cavity; and the cylinder shaped paint applicator roller member.
Figure 3:
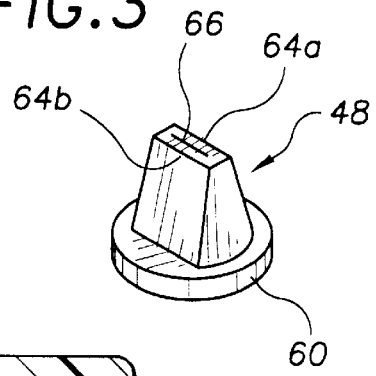
FIG. 3 is a perspective view of the duck bill one-way valve in isolation.

Referring to FIG. 2, applicator head cap assembly 14 includes a molded plastic head cap member, generally designated 26, having an internally threaded bottom portion 28 companionately threaded to thread onto exteriorly threaded neck portion 22 (FIG. 4) of paint container 12 (FIG. 4), an externally threaded portion 30, a horizontally oriented, semi-cylindrical roller cavity 32 formed in connection with a head cap member top surface 36, a duck bill one-way valve positioning cavity 38 formed therein in connection with roller cavity 32, and a paint passageway 40 in connection between duck bill one-way valve positioning cavity 38 and internally threaded bottom portion 28 in a manner, referring to FIG. 4, to form a fluid pathway from paint reservoir 18 of paint container 12 into roller cavity 32 of head cap member 26 when head cap member 26 is threaded fully onto exteriorly threaded neck portion 22 of paint container 12; referring back to FIG. 2, a resilient duck bill one-way valve 48 installed within duck bill one-way valve positioning cavity 38 in a manner to allow paint flow from paint reservoir 18 (FIG. 4) to roller cavity 32 and prevent the backflow of paint from roller cavity 32 to paint reservoir 18 (FIG. 4); and a cylinder shaped paint applicator roller member, generally designated 50, rotatably entrapped within roller cavity 32 having greater than fifty percent of the volume thereof positioned within roller cavity 32 and a remaining portion 54 thereof extending past head cap member top surface 36. In use remaining portion 54 is rolled over the area desired to be covered with paint. Referring to FIG. 3, resilient duck bill one-way valve 48 has a ring shaped base 60 and two resilient valve flaps 64*a*,64*b* formed together and having a flow slit 66 provided at a juncture thereof that is forced open by paint traveling from, referring now to FIG. 4, paint reservoir 18 through resilient duck bill one-way valve 48.

Transparent applicator head sealing cap 16 has internal threading 70 companionate with externally threaded portion 30 of head cap member 26 and an internal cavity 74 sized and shaped such that an internal top surface 76 defining the top of internal cavity 74 is in contact with paint applicator roller member 50 when transparent applicator head sealing cap 16 is fully threaded onto externally threaded portion 30 of head cap member 26.

It can be seen from the preceding description that a paint applicator has been provided that includes a flexible walled paint container, an applicator head cap assembly threadably attachable to the paint container, and a transparent applicator head sealing cap threadably sealable over the applicator head assembly; the paint container having a paint reservoir defined therein in connection with a neck opening defined by an exteriorly threaded neck portion; the applicator head cap assembly including a head cap member having an internally threaded bottom portion companionately threaded to thread onto the exteriorly threaded neck portion of the paint container, an externally threaded portion, a horizontally oriented, semi-cylindrical roller cavity formed in connection with a head cap member top surface, a duck bill one-way valve positioning cavity within the head cap member in connection with the roller cavity, a paint passageway in connection between the duck bill one-way valve positioning cavity and the internally threaded bottom portion in a manner to form a fluid pathway from the paint reservoir of the paint container into the roller cavity of the head cap member when the head cap member is threaded fully onto the exteriorly threaded neck portion of the paint container, a resilient duck bill one-way valve installed within the duck bill one-way valve positioning cavity in a manner to allow paint flow from the paint reservoir to the roller cavity and prevent the backflow of paint from the roller cavity to the paint reservoir, and a cylinder shaped paint applicator roller member rotatably entrapped within the roller cavity having greater than fifty percent of the volume thereof positioned within the roller cavity and a remaining portion thereof extending past the head cap member top surface; the transparent applicator head sealing cap having internal threaded companionate with the externally threaded portion of the head cap member and an internal cavity sized and shaped such that an internal top surface defining the top of the internal cavity is in contact with the paint applicator roller member when the transparent applicator head sealing cap is fully threaded onto the externally threaded portion of the head cap member; the paint container having sidewalls sufficiently flexible to allow a compression force to be developed by squeezing to force paint within the paint reservoir through the duck bill one-way valve into the roller cavity.

It is noted that the embodiment of the paint applicator described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A paint applicator comprising;

a flexible walled paint container;

an applicator head cap assembly threadably attachable to said paint container; and a transparent applicator head sealing cap threadably sealable over said applicator head assembly;

said paint container having a paint reservoir therein and a neck opening defined by an exteriorly threaded neck portion having a top rim;

said applicator head cap assembly including:

a head cap member having an internally threaded bottom portion companionately threaded to thread onto said exteriorly threaded neck portion of said paint container, said internally threaded bottom portion having an integral top wall that contacts said top rim of said neck portion and substantially blocks said neck opening when said head cap member is threaded onto said neck portion, an externally threaded portion, a horizontally oriented, semi-cylindrical roller cavity formed in a head cap member top surface, the bottom portion of said roller cavity having a continuous opening across the length thereof a one-way valve positioning cavity within said head cap member in connection with said roller cavity, the top wall of said internally threaded bottom portion of said head cap member forming the bottom wall of said one-way valve positioning cavity, the upper portion of the positioning cavity being coextensive with the continuous opening of the bottom portion of the roller cavity for continuous, unobstructed flow therebetween;

a paint passageway formed in said top wall of said internally threaded bottom portion of said head cap assembly to form a fluid pathway from said paint reservoir into said one-way valve positioning cavity when said head cap member is threaded fully onto said exteriorly threaded neck portion of said paint container;

a resilient duck bill one-way valve installed within said one-way valve positioning cavity and on top of said bottom wall thereof in a manner to allow paint flow from said paint reservoir, through said one-way valve positioning cavity, and into said roller cavity, and prevent back flow of paint from said roller cavity into said paint reservoir; and a cylinder-shaped paint applicator roller member rotatably entrapped within said roller cavity having greater than fifty percent of the volume thereof positioned within said roller cavity and a remaining portion thereof extending past said head cap member top surface;

said transparent applicator head sealing cap having an internally threaded bottom portion companionately threaded to thread onto said externally threaded portion of said head cap member and an internal cavity sized and shaped such that an internal top surface defining said top of said internal cavity is in contact with said paint applicator roller member when said transparent applicator head sealing cap is fully threaded onto said externally threaded portion of said head cap member;

said paint container having sidewalls sufficiently flexible to allow a compression force to be developed by squeezing to force paint within said paint reservoir through said duck bill one-way valve into said roller cavity.

* * * * *